US005367996A

United States Patent [19]

Homik et al.

[11] Patent Number: 5,367,996

[45] Date of Patent: Nov. 29, 1994

[54] MICROPROCESSOR-BASED DIESEL ENGINE COLD START CONTROLLER

[75] Inventors: William J. Homik, Ephrata; David G. Sokol, New Holland, both of Pa.

[73] Assignee: Ford New Holland, Inc., New Holland, Pa.

[21] Appl. No.: 122,659

[22] Filed: Sep. 17, 1993

[51] Int. Cl.[5] ..... F02N 17/047; F02N 17/08

[52] U.S. Cl. ..... 123/179.8; 123/179.13; 123/179.21

[58] Field of Search ..... 123/179.6, 179.5, 179.8, 123/179.12–179.15, 179.18, 179.21

[56] References Cited

U.S. PATENT DOCUMENTS 4,103,661 8/1978 Holt ..... 123/179.6

4,667,645 5/1987 Gluckman ..... 123/179.8

*Primary Examiner*—Andrew M. Dolinar

*Attorney, Agent, or Firm*—Griffin Butler Whisenhunt & Kurtossy

[57] ABSTRACT

A cold start control apparatus for diesel engines includes a cold start switch, engine temperature and speed sensors and a transistor all connected to a programmable controller. The transistor is connected in a series circuit with a cold start relay and the series circuit is connected to the run/crank positions of an ignition switch. The relay has a pair of contacts through which a battery voltage may be applied to a cold start assist apparatus provided for the engine. The cold start assist apparatus may be a thermostart element such as a glow plug ignitor, or a solenoid controlled ether injection system. A permanent memory in the controller stores an indication of the type of cold start assist apparatus provided for the engine. The controller senses for actuation of the cold start switch and applies a signal to the transistor thus turning it on if (1) the ignition key is in the run or crank position, (2) the engine is cold and (3) the cold start assist apparatus is a thermostart element. On the other hand if the cold start assist apparatus is an ether injection system, the controller responds to actuation of the cold start switch to apply a signal to the transistor only if (1) the engine is cold, (2) the ignition switch is in the crank position and (3) the engine speed is at least as great as a predetermined speed. While the transistor is on, voltage is applied to the cold start assist apparatus.

12 Claims, 2 Drawing Sheets

MICROPROCESSOR-BASED DIESEL ENGINE COLD START CONTROLLER

FIELD OF THE INVENTION

This invention relates to a controller for controlling the application of a cold start aid to a diesel engine. More particularly, the invention provides a microprocessor-based controller which may be used to control either thermostarts or ether injection as aids in cold starting diesel engines.

BACKGROUND OF THE INVENTION

It is conventional in the prior art to provide some form of starting assist to aid in the starting of diesel engines when the engines are cold. Two widely used starting assists are ether injection and glow plug ignitors which ignite a small quantity of diesel fuel in the engine manifold, the ignitors being generally referred to as thermostarts. Ether injection is preferred by some because it provides a faster cold start. On the other hand, others prefer thermostart because of low cost and the advantage of not having to replenish the starting aid.

Each type of starting assist has its own set of characteristics hence it has been conventional to provide separate hardware components and cabling specific to the starting assist on a particular engine. This increases manufacturing costs and complicates factory inventory and design.

SUMMARY OF THE INVENTION

An object of the present invention is to provide a reconfigurable starting assist controller for starting cold diesel engines, the controller being equally suitable for controlling either ether injection or thermostarts.

Another object of the invention is to provide a starting assist controller as described above which is inexpensive and requires few parts in addition to those already present on a conventional diesel powered tractor.

Still another object of the invention is to provide a diesel engine cold start control apparatus comprising a programmable controller having stored therein configuration data defining first and second types of cold start assist apparatus, a cold start assist apparatus for the engine, the cold start assist apparatus being one of the first and second types, an ignition switch, a cold start switch, the controller being responsive to actuation of the cold start switch for generating a signal having a first duration when the configuration data defines the first type of cold start assist apparatus and a second duration when the configuration data defines the second type of cold start assist apparatus, and means responsive to the signal and the ignition switch for energizing the cold start assist apparatus.

Another object of the invention is to provide a diesel engine cold start control apparatus as described above wherein the first type of cold start assist apparatus comprises a thermostart element and the second type of cold start assist apparatus comprises a solenoid operated ether injection apparatus.

A further object of the invention is to provide a diesel engine cold start control apparatus as described above and further including sensing means for sensing engine speed, the controller generating the signal only if the engine speed is greater than a predetermined speed if the cold start assist apparatus is an ether injection apparatus.

Yet another object of the invention is to provide a diesel engine cold start control apparatus as described above and further comprising an engine temperature sensor, the controller being responsive to the engine temperature sensor for preventing generation of the signal when the engine temperature is at least as great as a predetermined temperature.

Other objects of the invention and the manner of making and using it will become obvious upon consideration of the following description and the accompanying drawings.

DESCRIPTION OF THE INVENTION

Figure 1:
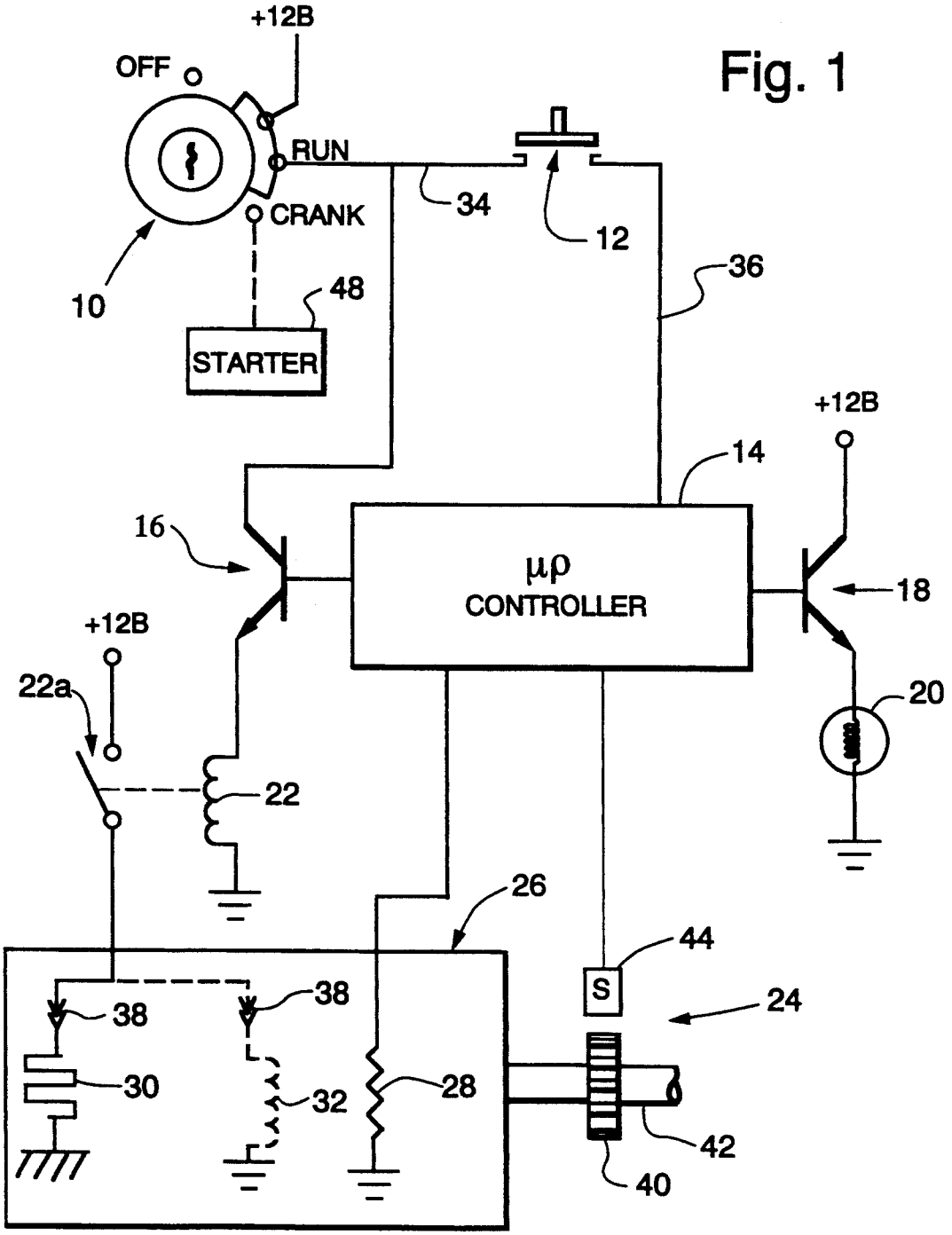
FIG. 1 is a schematic diagram of the diesel engine cold start control apparatus according to the present invention; and, FIG. 2 is a flow chart illustrating steps of a cold start routine executed by the controller to selectively control either a thermostart or ether injection apparatus.

Referring to FIG. 1, a diesel engine cold start control apparatus constructed in accordance with the principles to the present invention comprises an ignition switch 10, a momentary cold start switch 12, a microprocessor-based controller 14, two transistors 16 and 18, a cold start lamp 20, a cold start relay 22 having a set of normally open contacts **22*a*, and an engine speed sensor 24 for sensing the speed of a diesel engine 26. A temperature sensor 28 senses the temperature of engine 26 and the engine is provided with either a thermostart apparatus 30 comprising a glow plug ignitor or an ether injection apparatus 32 controlled by an ether injection solenoid. It should be understood that a particular diesel engine 26 has either the thermostart apparatus 30 for heating the engine combustion chambers by igniting a controlled volume of diesel fuel in the engine manifold or an ether injection system which injects ether into the air intake of the engine when solenoid 32** is energized.

Ignition switch 10 has three positions: OFF, RUN and CRANK. In the RUN and CRANK positions, and as the switch is moved between the RUN and CRANK positions, a battery voltage +12B is applied through switch 10 over a lead 34 to one side of the cold start switch 12. The cold start switch is located in the tractor cab within easy reach of the tractor operator. The other side of switch 12 is connected by a lead 36 to an input of the controller 14.

In like manner, when switch 12 is in the RUN or CRANK position or is being moved between the two positions, the battery voltage is applied through the switch to the collector of transistor 16. The base of the transistor is connected to receive output signals from controller 14. The emitter of transistor 16 is connected through the solenoid of cold start relay 22 to ground.

The normally open cold start relay contacts **22*a* are connected between +12B and a connector 38. This connector mates with a connector associated with engine 26 and connected to ground through a cold start assist apparatus which may be either the thermostart apparatus 30, as shown in solid lines in FIG. 1, or the ether injection solenoid 32** as shown in broken lines.

As subsequently explained, transistor 16 is turned on by a signal generated by controller 14. When the transistor is turned on, relay 22 is energized and the contacts **22*a* close so that battery voltage is applied to the thermostart apparatus 30 or ether injection solenoid 32, whichever is present. The transistor 16 and relay 22** thus comprise a gating means responsive to the signal generated by the controller for energizing the cold start assist apparatus. Although an electromechanical relay 22 is shown, an electronic relay may be used.

The transistor 18 has a collector connected to +12B and an emitter connected through the cold start lamp 20 to ground. The base of the transistor is connected to receive a signal from controller 14. When controller 14 issues a signal (about +5 V) it turns transistor 16 on thereby lighting the cold start lamp 20 for the duration of the signal.

The cold start lamp 20 is located on an operator's display console in the tractor cab. The lamp 20 is used in the present invention to visually signal the operator when the cold start assist apparatus is being energized (lamp on) or when it may be energized again (lamp off).

The controller 14 includes a microprocessor and analog-to-digital converters. The controller is connected to various sensors on the tractor and controls a display console (not shown) in the operator's cab to inform the operator of various conditions such as engine speed, engine temperature, ground speed, oil level, etc.

As shown in FIG. 1 the engine temperature sensor 28 and engine speed sensor 24 are connected as inputs to controller 14. The controller executes a program which is repeated every 10 ms. During each execution of the program the controller samples the magnitude of the signal produced by temperature sensor 28 and converts it to a digital value.

The speed sensor 24 comprises a toothed gear 40 mounted on the output shaft 42 of diesel engine 26, and a reluctance sensor 44 which senses the passage of teeth on the gear as the shaft rotates. The controller 14 accumulates pulses generated by sensor 44 to develop an indication of the speed of engine 26 in revolutions per minute of the shaft 42.

Figure 2:
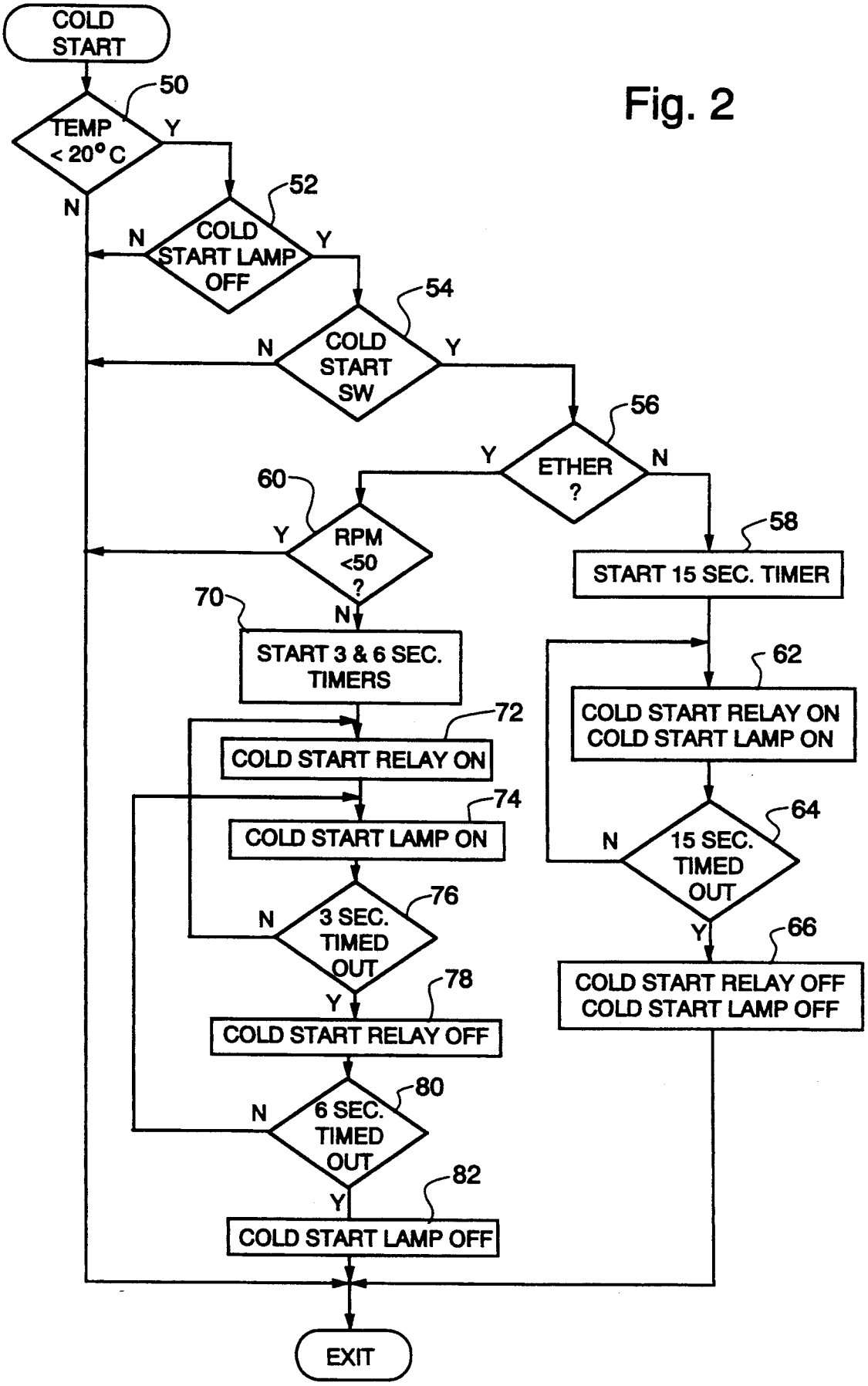

When the operator turns the ignition switch to the RUN position power is applied to the controller and it executes a power up reset after which it begins executing a main program. The program loops back and repeats every 10 ms. One of the steps in the main program loop is step 50 which is the entry step of a cold start routine shown in FIG. 2. At step 50 the controller determines if the engine is cold, that is, if engine temperature is less than 20° C.

If the engine is warm, a cold start assist is not required. After step 50 is executed the program exits the cold start routine of FIG. 2 and continues executing the main program loop.

If step 50 determines that the engine is cold, step 52 is executed to determine if the cold start lamp 20 is off. Assuming this is the first execution of the cold start routine the cold start lamp is off. The controller may determine if the cold start lamp is on or off by sampling a register bit which controls the application of the signal to the base of transistor 18.

The routine then moves to step 54 to determine if the cold start switch 12 has been actuated.

If the test at step 54 determines that the operator has not yet depressed cold start switch 12, an exit is made from the cold start routine and the controller continues executing the main control loop. The main loop is repeatedly executed and each time the cold start routine is reached steps 50, 52 and 54 are executed. This continues until the operator actuates the cold start switch 12.

On the first entry into the cold start routine after switch 12 is actuated, steps 50, 52 and 54 are executed as previously described. However, when step 54 is executed it determines that the cold start switch has been actuated so the program moves to step 56.

Step 56 determines the particular cold start assist associated with engine 26. In this regard, the controller includes an $E^2$PROM memory and stored within the memory is a system configuration data byte which defines certain physical attributes of the tractor. The system configuration data is set into the memory at the factory or a service center and includes an indication of whether the engine 26 has a thermostart apparatus 30 or an ether start apparatus 32. At step 56 the controller samples the system configuration byte and branches to either step 58 or step 60.

If step 56 shows that the engine is equipped with a thermostart apparatus 30, a branch is made to step 58 where a 15-second timer is started. At step 62 the controller applies signals to transistors 16 and 18. The signal applied to transistor 18 turns it on thereby turning the cold start lamp 20 on.

The signal applied to transistor 16 will turn the transistor on thereby energizing cold start relay 22. Relay contacts **22*a* close thereby applying battery voltage to the thermostart element 30. The element 30 ignites a small amount of fuel to warm the engine and if the operator has moved the ignition switch to the CRANK position a starter 48** is energized to crank the engine.

As represented by the loop comprising steps 62 and 64, the cold start lamp 20 is energized for the full 15-second interval initiated at step 58.

When the 15-second interval initiated at step 58 has elapsed, the routine advances to step 66 where the signals to transistors 16 and 18 are terminated. This turns the cold start lamp 20 off and deenergizes the cold start relay 22. Relay contacts **22*a* open to remove the battery voltage from the thermostart apparatus 30**.

After step 66 is completed an exit is made to the main program. If the engine does not start during the 15-second interval, the operator may try again by turning the ignition switch off and then repeating the sequence of steps described above. Alternatively, he may continue to hold the ignition switch in the CRANK position and again actuate the cold start switch 12.

If the test at step 56 indicates that the engine 26 is equipped with an ether cold start assist apparatus, the program branches to step 60 where the engine speed is tested to determine if the engine is being cranked. This is accomplished by sensing the rate of rotation of the engine output shaft 42. If the shaft is not rotating at more than 50 RPM, an exit is made from step 60 to the main program. This avoids injection of ether into the engine if the operator has not turned the ignition switch to the CRANK position or if the engine is not turned over in response to the ignition key being in the CRANK position.

When the main program next reaches the cold start routine step 50, steps 52, 54, 56, 58 and 60 are repeated as described above. If the operator has turned the ignition switch to the CRANK position and the engine starter has responded so that the engine speed is at least 50 RPM then from step 60 the routine advances to step 70 where timers are started to measure a 3-second and a 6-second interval. The cold start relay 22 is energized (step 72) and the cold start lamp 20 turned on (step 74) by sending signals to turn on transistors 16 and 18.

The 3-second timer started at step 70 times the duration of intervals that the cold start relay 22 is energized so that its contacts **22*a* close and energize solenoid 32 to inject ether into the air intake of the engine. During the timing of the 3-second interval the test at step 76 will prove false and the routine loops back to repeat steps 72 and 74. At the end of the 3-second interval the test at step 76 proves true and step 78 is executed to terminate the signal to transistor 16. This causes relay contacts 22***a* to open so that the ether injection solenoid 28 is deenergized.

The 6-second timer started at step 70 times the minimum interval which may occur between the beginnings of two ether injections. By the time step 78 is reached, three seconds of the 6-second interval have elapsed. For the next three seconds the routine repeatedly executes the loop including steps 80, 74, 76 and 78 thus keeping the cold start lamp 20 on. When the 6-second timer times out, the routine advances from step 80 to step 82 where the cold start lamp 20 is turned off before an exit is made to the main routine.

The 3-second timer times the actual period that injection solenoid 32 is energized to inject ether into the engine air intake. The 6-second timer insures that the operator cannot initiate another ether injection for at least three seconds after a previous injection is completed. This is a safety feature preventing the injection of too much ether in the event the engine does not start during an ether injection interval.

If the engine does not start during the first 6-second interval, the operator may initiate another ether injection by again depressing the cold start switch 12. The ether injection sequence will be repeated as described above if the operator is still holding the ignition switch 10 in the CRANK position.

In summary, steps 50, 52 and 54 of the cold start routine determine if a cold start assist is required. Step 56 determines the type of cold start assist apparatus provided for the engine. If the engine has a thermostart assist, steps 58, 62, 64 and 66 are executed to time (for 15 seconds) the energization of the thermostart apparatus 30. If the engine has an ether assist, step 60, as a safety measure, checks to see that the engine is being cranked, and if it is being cranked steps 72, 74, 76, 80 and 82 are executed to time one 3-second ether injection followed by a 3-second wait. After step 66 or 82 is executed, another timing sequence may be initiated by depressing the cold start switch 12.

From the foregoing description it is seen that the present invention provides a novel apparatus for selectively controlling either ether or thermostart cold start assists for diesel engines. The apparatus may be reconfigured merely by changing the configuration data in the controller memory so as to control cold starting of diesel engines having either type of cold start assist, hence a reduced number of parts is required in inventory. Furthermore, when applied to certain existing tractor models the only additional elements required are the cold start relay 22 and its transistor driver. At the same time, it permits elimination of a temperature (safe operation) switch required in the presently used ether assist cold start control.

While a preferred embodiment of the invention has been described in specific detail, it will be understood that various modifications and substitutions may be made in the described embodiment without departing from the spirit and scope of the invention as defined by the appended claims. For example, alcohol injection may be used as a cold start assist.

We claim:

1. A reconfigurable diesel engine cold start control apparatus comprising:

a programmable controller having stored therein configuration data defining first and second types of cold start assist apparatus;

a cold start assist apparatus for the engine, said cold start assist apparatus being one of said first and second types;

an ignition switch;

a cold start switch;

said controller being responsive to actuation of said cold start switch for generating a signal having a first duration when said configuration data defines said first type of cold start assist apparatus and a second duration when said configuration data defines said second type of cold start assist apparatus; and, means responsive to said signal and said ignition switch for energizing said cold start assist apparatus.

2. A reconfigurable diesel engine cold start control apparatus as claimed in claim 1 wherein said controller generates said signal no more than one time each time said cold start switch is actuated.

3. A diesel engine cold start control apparatus as claimed in claim 1 wherein said first type of cold start assist apparatus comprises a thermostart apparatus and said second type of cold start assist apparatus comprises an ether injection apparatus.

4. A reconfigurable diesel engine cold start control apparatus as claimed in claim 3 and further comprising an engine speed sensor, said controller including means responsive to said engine speed sensor for inhibiting generation of said signal when said configuration data defines said second type of cold start assist apparatus and the sensed engine speed is below a predetermined rate.

5. A reconfigurable diesel engine cold start control apparatus as claimed in claim 1 and further comprising an engine temperature sensor, said controller being responsive to said engine temperature sensor for preventing generation of said signal when the engine temperature is at least as great as a predetermined temperature.

6. A reconfigurable diesel engine cold start control apparatus as claimed in claim 5 wherein said controller senses actuation of said cold start switch by sampling a voltage on a lead connecting said cold start switch to said controller to determine if said cold start switch has been actuated, said controller sampling said voltage only if the engine temperature is below said predetermined temperature.

7. A reconfigurable diesel engine cold start control apparatus as claimed in claim 6 wherein said first type of cold start assist apparatus defined by the configuration data is a thermostart apparatus and said second type of cold start assist apparatus defined by the configuration data is an ether injection apparatus.

8. A reconfigurable diesel engine cold start control apparatus as claimed in claim 7 wherein said signal has a duration of about fifteen seconds when said configuration data defines said first type of cold start assist apparatus.

9. A reconfigurable diesel engine cold start control apparatus as claimed in claim 7 and further comprising an engine speed sensor, said controller including means responsive to said engine speed sensor for inhibiting generation of said signal when said configuration data defines said second type of cold start assist apparatus and the sensed engine speed is below a predetermined rate.

10. A reconfigurable diesel engine cold start control apparatus as claimed in claim 9 wherein said signal has a duration of about three seconds when said configuration data defines said second type of cold start assist apparatus.

11. A diesel engine cold start control apparatus as claimed in claim 10 wherein said controller delays sensing of actuation of said cold start switch for an interval of time after said signal is generated when said configuration data defines said second type of cold start assist apparatus.

12. A diesel engine cold start control apparatus as claimed in claim 11 and further comprising a cold start lamp, said controller energizing said cold start lamp during intervals said signal is generated.

* * * * *